US007560669B2

(12) United States Patent
Sahay et al.

(10) Patent No.: US 7,560,669 B2
(45) Date of Patent: Jul. 14, 2009

(54) METHOD OF THERMAL TREATMENT OF COMPONENTS

(75) Inventors: Satyam Suraj Sahay, Maharashtra (IN); Karthik Krishnan, Maharashtra (IN)

(73) Assignee: Tata Consulting Services Ltd., Mumbai (IN)

( * ) Notice: Subject to any disclaimer, the term of this patent is extended or adjusted under 35 U.S.C. 154(b) by 204 days.

(21) Appl. No.: 11/567,392

(22) Filed: Dec. 6, 2006

(65) Prior Publication Data

US 2007/0131672 A1 Jun. 14, 2007

(30) Foreign Application Priority Data

Dec. 14, 2005 (IN) ..... 1573/MUM/2005

(51) Int. Cl.
*H05B 1/02* (2006.01)

(52) U.S. Cl. ..... 219/494; 219/497; 392/416; 266/80

(58) Field of Classification Search ..... 219/490, 219/494, 497, 506; 392/416–420; 266/80–87
See application file for complete search history.

(56) References Cited

U.S. PATENT DOCUMENTS 3,198,676 A * 8/1965 Sprowls et al. ..... 148/502
5,035,754 A * 7/1991 Sakiyama et al. ..... 148/701
2005/0151306 A1* 7/2005 Sokolowski et al. ..... 266/80

OTHER PUBLICATIONS

S.S. Sahay et al., "Accelerated Grain Growth Behavior During Cyclic Annealing," Acta Materialia 51, No. 2, pp. 339-346, (2003).
C.A. Schuh et al., "Enhanced Densification of Zinc Powders Through Thermal Cycling," Acta Materialia 50, No. 6, pp. 1349-1358 (2002).
S.S. Sahay, "Energy Reduction Via Cyclic Heat Treatments," Forecast Issue of ASM Heat Treating Progress, pp. 44-45 (Jan./Feb. 2003).
H. Geng et al., "Thermal Cycling Behavior of As-Quenched and Aged Ti-6Al-4V Alloy," Metallurgical and Materials Transactions A, vol. 28A, pp. 1809-1814 (Sep. 1997).

* cited by examiner

*Primary Examiner*—Mark H Paschall
(74) *Attorney, Agent, or Firm*—Greenblum & Bernstein P.L.C.

(57) ABSTRACT

A method of thermal treatment of components. The optimum thermal amplitude of the components at which the phase transformation kinetics of the components is maximum is determined by subjecting samples of the components to cyclic thermal processing at various thermal amplitudes by maintaining the upper temperature constant and varying the lower temperature. A thermal amplitude which is higher than the optimum thermal amplitude is selected. The components are subjected to cyclic thermal processing at the thermal amplitude selected above to achieve near uniform phase transformation kinetics of the components across their cross-section. The components are cooled down to room temperature to obtain components with near uniform microstructure and properties.

8 Claims, 4 Drawing Sheets

METHOD OF THERMAL TREATMENT OF COMPONENTS

FIELD OF INVENTION

This invention relates to a method of thermal treatment of components.

The term "components" as used in the specification includes parts which are fabricated, shaped, formed or cast with materials or compacted with powder. Examples of the components include bearings, wheels, sprockets, gears, shafts, wires or rods used in various industries including automotive, aerospace or electrical and electronic industries.

BACKGROUND OF INVENTION

Components are subjected to thermal treatment to bring about changes in their microstructure and to develop various properties such as hardness, ductility or tensile strength so as to obtain the desired performance of the components. Thermal treatment is generally carried out by isothermal processing or cyclic thermal processing. Isothermal or cyclic thermal processing comprises isothermal or cyclic annealing, age hardening or sintering. During isothermal thermal processing, depending upon the material and nature of the components, they are heated to a set temperature, soaked at this temperature for a predetermined period of time and cooled to a predetermined temperature. Heating and cooling of the components is repeated for a set period of time before the components are finally cooled down to room temperature. During isothermal thermal processing, the surface and core regions of the components are invariably at different temperatures ie during the heating cycle the surface region attains the desired temperature faster than the core region and is hotter than the core region and during the cooling cycle the surface region becomes cooler faster than the core region and is cooler than the core region. As the core region lags in attaining the desired temperature, phase transformation kinetics at the core is not as fast as the phase transformation kinetics at the surface region. Therefore, development of changes in the microstructures and properties of the components vary or differ across the crosssection of the components. Such variations in the microstructures and properties of the components reduce the performance of the components. Moreover, the time required for isothermal thermal processing is longer thereby reducing productivity. Also, as the isothermal thermal processing involves heating of the components at a constant temperature for a long duration, the energy consumption is high. Because of reduced productivity and high energy consumption, isothermal thermal processing is very expensive. Due to high temperature heating for long duration, emissions from the furnace are also correspondingly increased. During cyclic thermal processing, the components are heated between two temperatures before being cooled down to room temperature. This accelerates phase transformation kinetics and development of changes in the microstructures and properties of the components. [Ref Acta Materialia, Vol 51, No 2, (2003) 339-346 titled "Accelerated grain growth behavior during cyclic annealing" by S. S. Sahay, C. P. Malhotra and A. M. Kolkhede; Acta Materialia, Vol. 50, No. 6 (2002) 1349-1358 titled "Enhanced densification of zinc powders through thermal cycling" by C. A. Schuh and D. C. Dunand; Metallurgical and Materials Transactions, Vol. 28A (1997) 1809-1814 entitled "Thermal cycling behavior of as quenched and aged ti-6al-4v alloy" by H. Geng, S. He, and T. Lei]. Due to the accelerated development of changes in the microstructures and properties of the components, the heating time is reduced and productivity is increased. As the thermal processing is carried out between two temperatures for a short duration, the energy requirement is also reduced correspondingly reducing emissions from the furnace. (Ref Forecast Issue of ASM Heat Treating Progress, January 2003, 44 titled "Energy reduction via cyclic heat treatments" by Satyam S Sahay). Due to increased productivity and reduced energy consumption, cyclic thermal processing is cost effective. During cyclic thermal processing also, however, development of changes in the microstructures and properties of the components differ across the crossection thereof as the core region lags in attaining the desired temperature as compared to the surface region. As a result, as in the case of similar to the isothermal processing, the performance of components obtained by cyclic thermal processing is also reduced.

OBJECTS OF INVENTION

An object of the invention is to provide a method of thermal treatment of components, which method produces components having near uniform changes in their microstructures and properties across the crosssection thereof thereby improving the performance of the components.

Another object of the invention is to provide a method of thermal treatment of components, which method reduces the treatment time and increases productivity.

Another object of the invention is to provide a method of thermal treatment of components, which method requires reduced quantity of energy and treatment time correspondingly reducing emissions from the furnace.

Another object of the invention is to provide a method of thermal treatment of components, which method is cost effective.

DETAILED DESCRIPTION OF INVENTION

According to the invention there is provided a method of thermal treatment of components comprising:

(a) determining the optimum thermal amplitude of the components at which the phase transformation kinetics of the components is maximum by subjecting samples of the components to cyclic thermal processing at various thermal amplitudes by maintaining the upper temperature constant and varying the lower temperature;

(b) selecting a thermal amplitude which is higher than the optimum thermal amplitude;

(c) subjecting the components to cyclic thermal processing at the thermal amplitude selected in step (b) to achieve near uniform phase transformation kinetics of the components across their crosssection; and (d) cooling down the components to room temperature to obtain components with near uniform microstructure and properties.

The higher thermal amplitude is selected in step (b) by mathematical simulation or experimentally after the optimum thermal amplitude is determined.

The upper temperatures of the various thermal amplitudes at which the components are subject to cyclic thermal annealing in step (a) will depend upon the material of the components and is generally the higher temperature at which the isothermal thermal processing of the components is carried out. Typically for titanium, steel or aluminium the upper temperatures are 925° C., 725° C. and 450° C., respectively.

Figure 1:
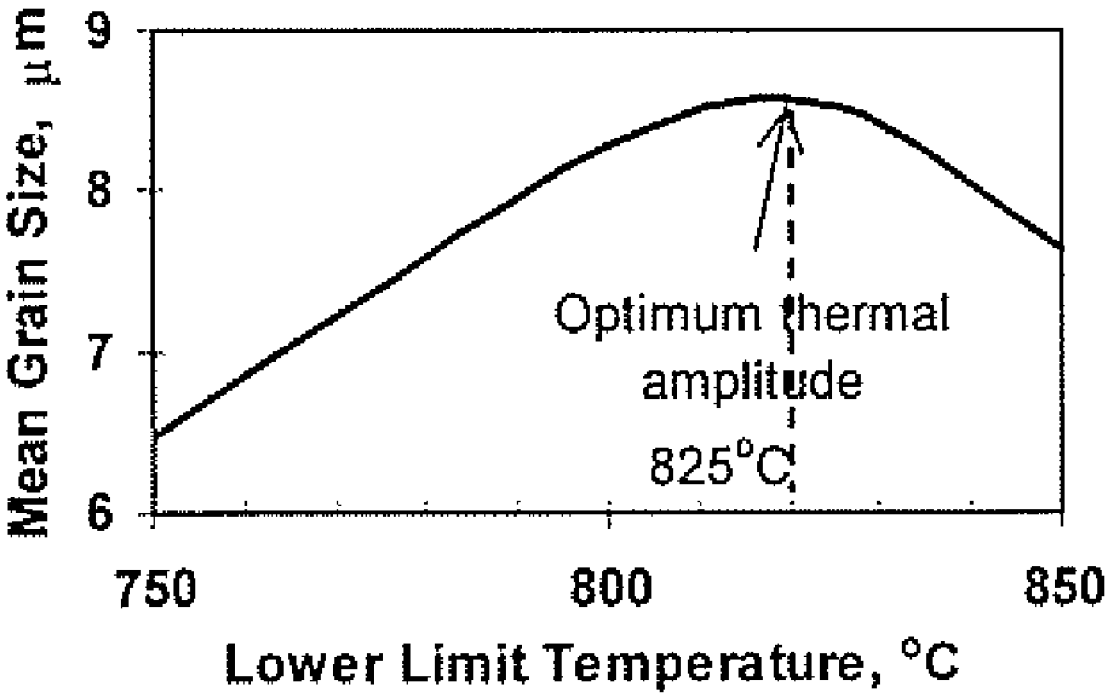
FIG. 1 is a graph illustrating the optimum thermal amplitude at which phase transformation kinetics of the samples was maximum was found.
Figure 2:
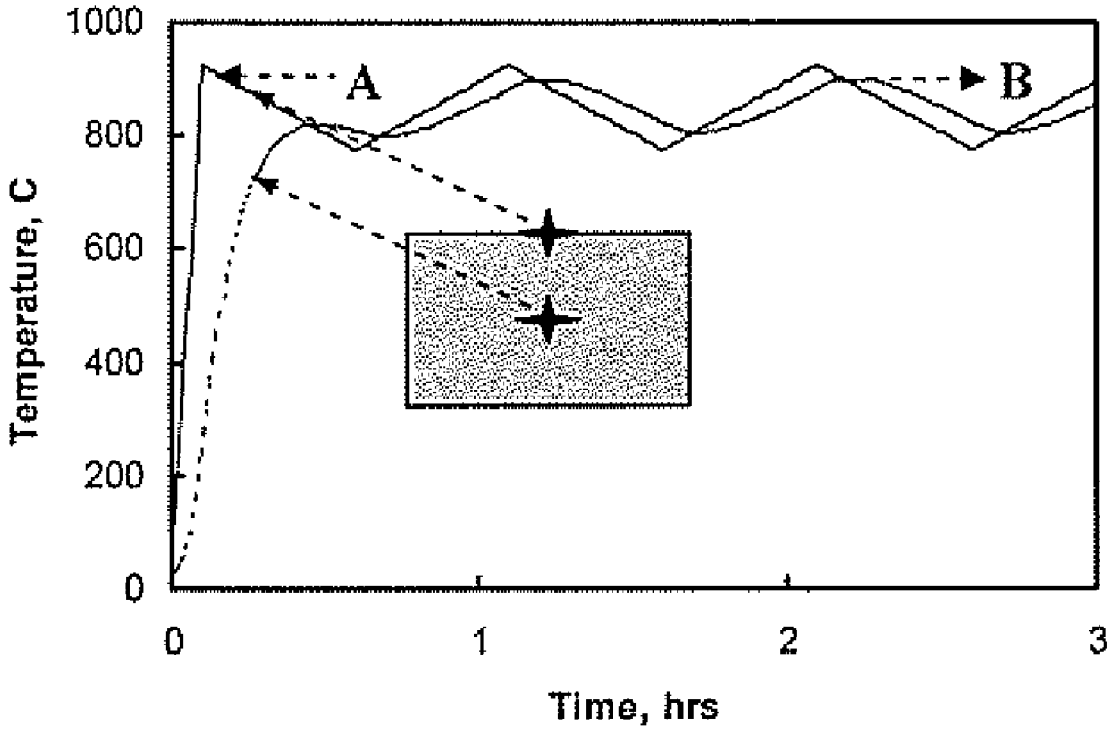
FIGS. 2, 3, and 4 are graphs illustrating test results.
Figure 3:
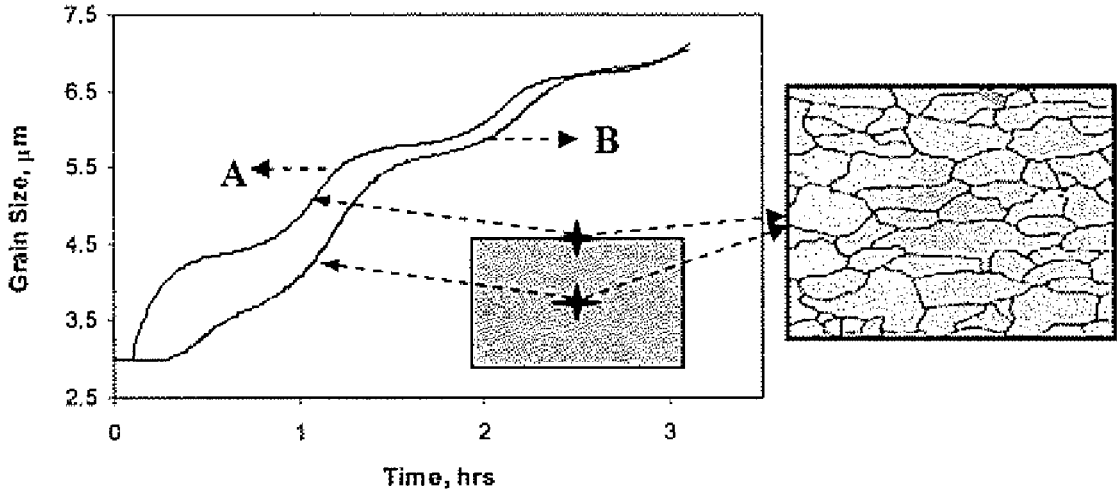
Figure 4:
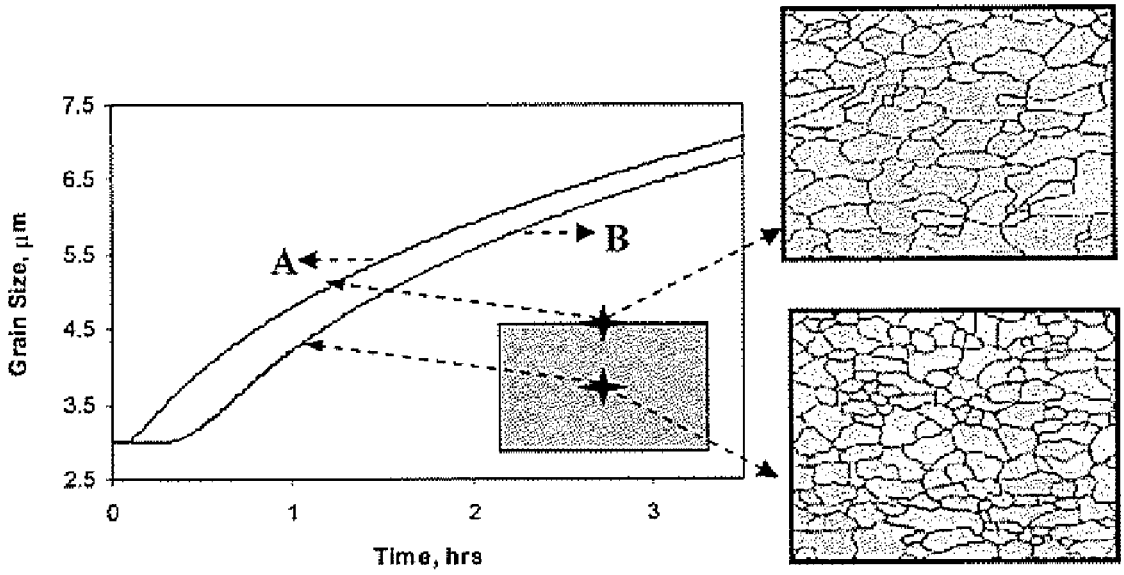

The following comparative experimental example is illustrative of the invention but not limitative of the scope thereof:

EXAMPLE 1 a) Samples from Ti-6A1-4V alloy rods (each of 15 mm diameter and 3 mm thickness) were subjected to cyclic thermal processing at different thermal amplitudes in a laboratory furnace. The upper temperature of the thermal amplitudes was kept constant at 925° C. and the lower temperature of the thermal amplitudes was varied from 750 to 850° C. The heating and cooling rates for all the samples were kept at 5° C./min. The optimum thermal amplitude at which phase transformation kinetics of the samples was maximum was found to be when the samples were annealed at the thermal amplitude of 100° C. with the higher and lower temperatures at 925° C. and 825° C., respectively as illustrated in FIG. 1 of the accompanying drawings. A thermal amplitude of 150° C. higher than the optimum thermal amplitude was selected wherein the upper temperature was 925° C. and the lower temperature was 775° C. The higher thermal amplitude was selected by mathematical simulation. The rods were subjected to cyclic thermal processing at the thermal amplitude of 150° C. for 3 hrs in a batch furnace. The heating and cooling rates of the rods were kept at 5° C./min. The rods were cooled down to ambient temperature after 3 hrs of thermal processing and subjected to simulation tests. The test results were as shown in FIGS. 2 and 3 of the accompanying drawings. Curve A and curve B in FIG. 2 relate to the temperature profile or evolution of heat in the surface and core regions of the gears, respectively. It is seen from FIG. 2 that at any given point during thermal processing the core region of the rods lies at the optimum thermal amplitude of 100° C. and that the temperature in the surface and core regions of the rods was practically the same. As the core region lies at the optimum thermal amplitude, the phase transformation characteristics of the core is maximum. This gives rise to near uniform development of changes in the microstructures and properties of the components across their crosssection. Curve A and curve B in FIG. 3 relate to the grain size in the surface and core regions of the rods, respectively. It is seen that after approximately 3 hrs of cyclic thermal processing, the grain size of the surface region and the core region was practically the same.

b) Samples from Ti-6A1-4V alloy rods (each of 15 mm diameter and 3 mm thickness) were subjected to isothermal thermal processing at 925° C. in a laboratory furnace for 3.5 hrs. After the 3.5 hrs the rods were cooled down and subjected to simulation tests. The test results were as shown in FIG. 4 of the accompanying drawings. Curve A and curve B in FIG. 4 relate to the grain size in the surface and core regions of the rods, respectively. It was seen that even after approximately 3.5 hrs of thermal processing, the grain size of the surface region and the core region was non-uniform. Performance of the components obtained by isothermal thermal processing as described above would be correspondingly reduced due to the non-uniform changes in the microstructures of the components and properties across the crosssection thereof. According to the invention cyclic thermal processing is carried out at a thermal amplitude at which phase transformation kinetics of the core is maximum so that development of changes in the microstructures and properties of the components both in the core and surface regions thereof is near uniform. This enhances the performance of the components. As the development of changes in the microstructures and properties of the components is faster, the duration of the method of the invention is reduced and productivity is increased. As the thermal processing is carried out between two temperatures the energy requirement of the method of the invention is also reduced. The reduced energy requirement and process time significantly reduces the emissions from the furnace. The method of the invention is cost effective because of the increased productivity and reduced energy requirement.

We claim:

1. A method of thermal treatment of components comprising:

(a) determining the optimum thermal amplitude of the components at which the phase transformation kinetics of the components is maximum by subjecting samples of the components to cyclic thermal processing at various thermal amplitudes by maintaining the upper temperature constant and varying the lower temperature;

(b) selecting a thermal amplitude which is higher than the optimum thermal amplitude;

(c) subjecting the components to cyclic thermal processing at the thermal amplitude selected in step (b) wherein the upper temperature is maintained at a same value and the lower temperature is varied; and (d) cooling down the components to room temperature.

2. A method as claimed in claim 1, wherein the cyclic thermal processing is carried out by cyclic annealing, age hardening or sintering.

3. A method as claimed in claim 1, wherein the lower temperature of the higher thermal amplitude selected at step (b) is 50-150° C. lower than the upper temperature of the higher thermal amplitude selected at step (b).

4. A method as claimed in claim 1, wherein the cyclic thermal processing at step (c) is carried out by heating and cooling the components at the rates of 5-15° C./min.

5. Components obtained by the method as claimed in any one of claim 1.

6. Components obtained by the method as claimed in claim 2.

7. Components obtained by the method as claimed in claim 3.

8. Components by the method as claimed in claim 4.

* * * * *